US011548256B2

(12) United States Patent
Schalk et al.

(10) Patent No.: US 11,548,256 B2
(45) Date of Patent: Jan. 10, 2023

(54) CUSHION SUPPLY SYSTEM AND METHOD OF OPERATION FOR A CUSHION SUPPLY SYSTEM

(71) Applicant: Sprick GmbH Bielefelder Papier-und Wellpappenwerke & Co., Bielefeld (DE)

(72) Inventors: Bastian Schalk, Detmold (DE); Marco Schwarberg, Melle (DE)

(73) Assignee: Sprick GmbH Bielefelder Papier- Und Wellpappenwerke & Co., Bielefeld (DE)

( * ) Notice: Subject to any disclaimer, the term of this patent is extended or adjusted under 35 U.S.C. 154(b) by 0 days.

(21) Appl. No.: 16/568,898

(22) Filed: Sep. 12, 2019

(65) Prior Publication Data

US 2020/0180257 A1 Jun. 11, 2020

Related U.S. Application Data

(63) Continuation of application No. PCT/EP2018/055938, filed on Mar. 9, 2018.

(51) Int. Cl.
*B31D 5/00* (2017.01)

(52) U.S. Cl.
CPC ..... *B31D 5/0078* (2013.01); *B31D 2205/007* (2013.01); *B31D 2205/0047* (2013.01); *B31D 2205/0088* (2013.01)

(58) Field of Classification Search
CPC .. B31D 5/0039; B31D 5/0073; B31D 5/0078; B31D 2205/007
USPC ..... 53/472
See application file for complete search history.

(56) References Cited

U.S. PATENT DOCUMENTS

| | | | | |
|---|---|---|---|---|
| 4,854,109 | A | 8/1989 | Pinarer et al. | |
| 5,864,484 | A | 1/1999 | Harding | |
| 7,914,239 | B2 * | 3/2011 | Van Huis | B31D 5/0073 406/88 |
| 2002/0070241 | A1 | 6/2002 | Wehrmann | |

(Continued)

FOREIGN PATENT DOCUMENTS

| | | | |
|---|---|---|---|
| AT | 75 196 | B | 5/1992 |
| DE | 195 19 792 | A1 | 12/1996 |
| DE | 695 09 535 | T2 | 10/1999 |

(Continued)

OTHER PUBLICATIONS

International Search Report and Written Opinion of the International Search Authority dated Aug. 28, 2018 in International Application No. PCT/EP2018/055938 (English and German languages) (22 pp.).

(Continued)

*Primary Examiner* — Chelsea E Stinson
(74) *Attorney, Agent, or Firm* — Banner & Witcoff Ltd.

(57) ABSTRACT

In a cushion supply system for a logistic center, for example a warehouse or a dispatch hall, which comprises a cushion source for providing cushion products, such as cushion pads, in particular paper cushion pads; several packing stations at which containers can be loaded with goods and filled with cushion products; and a cushion transport system, such as a belt conveyor, for transporting the cushion products from the cushion source to the packing stations, the one cushion source is configured to supply said plurality of packing stations.

17 Claims, 6 Drawing Sheets

(56) References Cited

U.S. PATENT DOCUMENTS

| | | | | |
|---|---|---|---|---|
| 2005/0055987 | A1* | 3/2005 | White | B65B 55/20 53/495 |
| 2005/0178085 | A1* | 8/2005 | Huis | B31D 5/0073 53/403 |

FOREIGN PATENT DOCUMENTS

| | | | |
|---|---|---|---|
| DE | 103 32 538 | A1 | 2/2005 |
| DE | 601 07 753 | T2 | 5/2005 |
| DE | 698 28 186 | T2 | 12/2005 |
| DE | 10 2008 039 550 | A1 | 3/2010 |
| DE | 10 2011 000 561 | A1 | 8/2012 |
| EP | 0 316 850 | A1 | 5/1989 |
| EP | 2 711 167 | A1 | 3/2014 |
| EP | 2 711 168 | A1 | 3/2014 |
| WO | WO 99/17923 | A1 | 4/1999 |
| WO | WO 2015/039756 | A1 | 3/2015 |

OTHER PUBLICATIONS

Office Action dated Dec. 6, 2017 for German Patent Application No. 10 2017 002 325.5, (8 pp. ), note: pp. 1 and 2 are English language Explanations to Section C. Result of Determination Document.

* cited by examiner

CUSHION SUPPLY SYSTEM AND METHOD OF OPERATION FOR A CUSHION SUPPLY SYSTEM

PRIORITY

This application is a continuation application of International PCT Patent Application No. PCT/EP2018/055938 filed on Mar. 9, 2018, entitled "UPHOLSTERY SUPPLY SYSTEM AND OPERATING METHOD FOR AN UPHOLSTERY SUPPLY SYSTEM," which claims priority to German Patent Application No. 10 2017 002 325.5 filed on Mar. 13, 2017, the entire contents of both of which are incorporated herein by reference.

TECHNICAL FIELD

The invention generally concerns a cushion supply system for a logistic center, for example a warehouse or a dispatch hall, and a method of operation for a cushion supply system for conveying cushion products. A logistic center can be realised as a pure logistic center for receiving, storing and dispatching goods. It is also possible to realize a logistic center as part of or directly connected to a production center, such as a factory, where products are produced that are prepared for dispatch in the logistic center.

BACKGROUND

Since products for dispatch usually cannot simply be placed loose in dispatch containers, such as cardboard cartons, wooden crates, lattice baskets or the like, because they would then be damaged or even destroyed by the vibrations and movements occurring during transport, it is customary to fill the empty space in the inner volume of a dispatch container, which surrounds the products to be dispatched, with one or more cushion products.

A wide variety of cushion products are known in the state of the art, such as foamed plastic (polystyrene), air-filled plastic film pads or paper cushion pads. Cushion products, such as cushion pads, made of paper, especially recycled paper, have the advantage over plastic cushion products of being much more environmentally friendly and are therefore generally preferred.

Cushion sources for providing cushion products used in logistic centers to provide cushion products are for example known from EP 2 711 167 B1, EP 2 711 168 B1 and WO 2015 039 756 A1. EP 2 711 167 B1 concerns a device patented by the applicant for the mechanical production of a three-dimensional packaging product made of a section formed in a predetermined manner of a single- or multi-layer paper web. Waste paper in particular can be used for the paper web. The paper web can be drawn off from a paper web reel or a paper web laporell stack and from there reaches the packaging product production device. This comprises a preforming station which preforms the paper web to form a three-dimensional packaging product, a so-called cushion tube, with a crumple cavity extending in the web direction. The central area of the spiral-shaped paper tube is then plastically deformed by means of a pair of embossing wheels, so that a sequence of embossing valleys and embossing donors are inserted in longitudinal direction of the tubular paper web section. In this way, in the preforming station, the paper web is brought into a dimensionally stable three-dimensional cushion shape having at least one crumple cavity to provide a damping and cushioning function. The preforming station is followed in conveying direction by a cut-off station, which cuts off cushion products of desired length in form of cushion pads from the preformed paper tube. The cushion pads are then ejected from the cushion material production device according to EP 2 711 167 B1 to fill cavities in the dispatch containers with the cushions.

In a logistic center there are usually numerous packing stations at which dispatch containers, such as cartons, can be loaded with goods and filled with cushion products. For this purpose, each individual packing station is equipped with an cushion product production device and comprises a certain paper web supply, which can be realized as a leporello stack or paper web roll, for example. To ensure that the individual cushion pads are delivered directly from the cushion pad production device into a dispatch container, the production device is usually attached to the packing station directly above a supporting surface for dispatch containers, for example at a frame. The production device can be operated by packing personnel at each packing station to produce a desired quantity of cushion pads and eject it into a present dispatch container. The paper web supply may be arranged at the cushion pad production device or below or adjacent to the support surface for the dispatch container.

In particular, improper operation of a cushion pad production device may result in a paper jam that causes the cushion pad production device and therefor its associated packing station to fail until the problem is resolved. The cushion pad production device also fails when refilling the paper web supply. Since logistic service providers are under considerable cost pressure, a high utilization rate and high reliability of the logistic center are necessary in order to bear the operating costs of the logistic center. In engaged logistic centers, failure of a packing station can quickly lead to bottlenecks that cause the entire dispatch from the logistic center to stall because a planned quantity of dispatch containers cannot be made ready for dispatch.

Another plant or machine for the production of shock-absorbing elements which, for example, converts paper fabric or material into shock-absorbing material with which the probability of failure of packing stations in a logistic center is to be reduced is known from DE 695 09 535 T2. DE 695 09 535 T2 describes a network for the production of shock absorbing elements in which two cushion pad production devices are controlled by a single supervisory control unit to supply a single packing station used by an operator with cushion pads. Thereby, only a first production device should be active to create cushion for the operator's packing station while the other device stands still. In accordance with DE 695 09 535 T2, this active cushion pad production device produces a desired number of cushion pads of the desired length and places them on a conveyor system to carry the cushion pads from the active device to the packing station. If, for example, the first device is not working because of a paper jam or shortage becomes inoperative and thus inactive, the second device takes over its function. The cushion pads are then transported from the second production device to the operator's packing station.

It is common to the known cushion pad production devices that equipping a logistic center with numerous packing stations requires considerable investment expense for the operators of the logistic center. The considerable investment expense is due to the costs for sufficient space not only for the packing stations but also for the respective paper web stocks. On the other hand, there is investment expense in form of costs for the cushion pad production devices themselves.

SUMMARY

It is a task of the invention to provide a cushion supply system that overcomes the drawbacks of the state of the art and that particularly involves reduced investment and operating expense especially compared to known cushion product production devices. This task is solved by the objects of independent claims.

Accordingly, a cushion supply system is intended for a logistic center, for example a warehouse or a dispatch hall. The cushion supply system according to the invention comprises a cushion source for providing cushion products, such as cushion pads, preferably paper cushion pads, in particular recycled paper cushion pads. The cushion products provided by the cushion source, such as cushion pads, preferably have a width of 5 cm to 50 cm, in particular 10 cm to 30 cm, preferably a width of about 15 cm, and/or a length of 15 cm to 300 cm, in particular 30 cm to 150 cm, preferably 35 cm to 75 cm, in particular 40 cm. Cushion products, such as cushion pads, in particular made of paper, preferably waste paper or recycled paper, preferably have a density between 1 $kg/m^3$ and 100 $kg/m^3$, preferably between 3 $kg/m^3$ and 30 $kg/m^3$, in particular less than 20, preferably less than 10 $kg/m^3$, in particular preferably between 5 $kg/m^3$ and 8 $kg/m^3$, for example about 6.8 $kg/m^3$. A cushion source for providing paper cushion pads may, for example, be realized according to a packaging material production device according to EP 2 711 167 B1, EP 2 711 168 B1 and/or WO 2015 039 756 A1, which are hereby included in their entirety by reference.

According to the invention, the cushion supply system comprises several packing stations at which containers; in particular dispatch containers such as cartons, crates, baskets or the like, can be loaded with goods and filled with cushion products. A packing station can, for example, be realized by a work supporting surface of a table or the like. According to the invention, the one preferably single cushion source is configured to supply the several packing stations of the cushion supply system. In particular, a cushion supply system comprising several packing stations, preferably two packing stations, four packing stations, six packing stations or more packing stations, comprises no more than two, in particular no more than one cushion source for supplying cushion products. The cushion supply system according to the invention also includes a cushion transport system, such as a belt conveyor, to transport the cushion products from the cushion source to the packing stations. Preferably, the cushion transport system, preferably a conveyor belt for transporting in particular the cushion pads, can be operated with a transport speed of between 0.1 m/s and 10 m/s, in particular between 0.5 m/s and 5 m/s, preferably between 1 m/s and 2 m/s, in particular with a transport speed of approximately 1.3 m/s. A belt conveyor preferably comprises a fabric belt. The cushion transport system, in particular the belt conveyor, may comprise a slip-resistant and/or for improved adhesion of cushion products, in particular cushion pads, such as paper cushion pads profiled surface structure.

Compared to conventional systems, for a cushion supply system according to the invention reduced investment costs are required such that for several packing stations only a single, common cushion source has to be provided. Surprisingly, it has been shown that by using a cushion transport system, failures of the cushion source can be compensated well, so that the probability of failure of the cushion supply system is nevertheless very low, so that the operating costs can also be easily calculated and kept low. If the cushion source fails, for example because a paper web supply or the like is exhausted and needs to be replaced, or due to a paper jam, already prepared cushion products that are still on the cushion transport system or already at the packing stations can initially be used to uninterruptedly fill dispatch containers with cushion products. During the supply from the stock at the packing stations and/or in the transport system, the cushion source is put back into operation, preferably before a bottleneck occurs at one or more of the packing stations.

According to one of the preferred embodiments of the invention, at least one of the several packing stations has a stock withdraw container for receiving a plurality of cushion products. Preferably, the several packing stations can each have a stock withdraw container for holding a plurality of cushion products. Preferably, a storage withdraw container can hold at least 10, at least 20, at least 50 or at least 100 cushion products. Preferably, a storage withdraw container can hold a maximum of 1000, a maximum of 500, a maximum of 200 or a maximum of 100 cushion products. An cushion supply system with stock withdraw containers at two or more of the several packing stations, preferably with stock withdraw containers at all of the packing stations, may have stock withdraw containers of the same or different size. Preferably, the cushion transport system of the cushion supply system is configured to transport the cushion products from the cushion source to any of the possibly existent stock withdraw containers at the packing stations. A stock withdrawal container may be, for example, a cubic vessel with one or more openings for loading and/or unloading cushion products into or from the stock withdrawal container. By providing stock withdraw containers, the number of cushion products, in particular the cushion pads, which can preferably be dimensioned as described above, can be increased in a cushion supply system in such a way that in the event of a scheduled or unintentional failure of an cushion source, a bottleneck of cushion products at all packing stations can be ruled out with certainty.

According to the preferred further embodiment of the invention, at least one stock withdrawal container, preferably each of the stock withdrawal containers, comprises at least one filling quantity sensor for determining the filling level of the stock withdrawal container occupied by the cushion products. A stock withdrawal container with a filling quantity sensor can preferably continuously determine the current filling level of the stock withdrawal container occupied by cushion products. Based on measurements of filling quantity sensors in several stock withdrawal containers in the cushion supply system, an electronic control and/or regulate system of the cushion supply system can monitor the quantity of cushion products present in the cushion supply system and control the production of cushion products by the cushion source and/or the transport of cushion products to one or more of the several packing stations as required.

Alternatively or additionally, at least one stock withdrawal container, preferably all stock withdrawal containers in each case, has at least one or exactly one filling level sensor in order to detect whether the filling level of the stock withdrawal container occupied by cushion products exceeds a predetermined filling level limit value. A light barrier, for example, which is arranged at a predetermined filling level above the bottom of the stock withdrawal container, can be used as a filling level sensor in order to determine whether the current filling level is lower than the predetermined filling level at which the sensor, in particular the light barrier, is arranged, or whether the current filling level exceeds the predetermined filling level of the sensor, in particular the light barrier. It is also conceivable that at least one container has two or more filling level sensors to check for exceeding or falling below a predetermined lowest minimum filling level and a predetermined maximum filling level. In this way, both emptying and overflowing of the stock withdrawal container can be easily avoided. The use of three, four or more level sensors at different predetermined levels can simplify the controllability of the filling of the stock withdrawal container.

According to a preferred embodiment of the invention, at least one stock withdrawal container, preferably all stock withdrawal containers, has a preferably top loading opening for feeding cushion products from the transport system into the stock withdrawal container. Alternatively or additionally, according to a preferred further embodiment of the invention, at least one stock withdrawal container, preferably all stock withdrawal containers in each case, may comprise a withdrawal opening for withdrawal of a cushion product by packing personnel, in particular in horizontal direction. Preferably at least one stock taking container, preferably all stock withdrawal containers in each case, comprises two openings, namely a loading opening and a different unloading opening. The unloading opening may preferably be located between 0.80 m and 2.20 m in height, in particular between hip height and shoulder height, preferably between 1.00 m and 1.70 m above the footprint of the cushion supply system, in particular preferably between 1.10 m and 1.50 m. A stock withdrawal container with two different dedicated (loading and unloading) openings is also well suited in combination with a filling level sensor arranged vertically between the unloading opening and the loading opening at a predetermined height to ensure that each stock withdrawal container is always adequately stocked with cushion products. The use of different dedicated loading and unloading openings ensures safe and ergonomic handling of the cushion supply system for the packing personnel.

According to a preferred embodiment of the invention, which can be combined with previous ones, the cushioning supply system has a preferably unidirectional main conveyor line, in particular a belt conveyor, as well as at least one deflection device, such as a switch, a trap door or the like, for feeding cushion products from the main conveyor line to at least one packing station, in particular to a stock withdrawal container. Preferably, for each of several packing stations, in particular several stock withdrawal containers, or all packing stations, in particular all stock withdrawal containers, a deflection device may be provided. The number of deflection devices may be equal to the number of packing stations, in particular the number of stock withdrawal containers, minus one. The deflector device or deflector devices are preferably configured to move at least one cushion product transversely to the main direction of movement of the main conveyor line. Preferably at least one deflection device is configured to deflect, in particular to push down, at least one cushion product laterally from the main conveyor line. For example, a cushion supply system can be equipped with a main conveyor line that supplies several packing stations, each with a stock withdrawal container. A deflection device is preferably provided for at least one, preferably several, of the stock withdrawal containers in order to divert one or several cushion products from the main conveyor line into a stock withdrawal container, in particular to convey them into a loading opening, preferably on the upper side, of the respective stock withdrawal container. It is clear that a deflector device can also be used without a storage withdrawal container, wherein the deflector device transports one or more cushion products from the main conveyor line to the respective packing station.

According to a preferred further embodiment of the invention, the main conveyor line transports the cushion products preferably in horizontal direction at least 2 m height and/or above the at least one stock withdrawal container, in particular above the loading opening(s) of the stock withdrawal container(s). By arranging the main conveyor line for conveying cushion products in horizontal direction at a height of at least 2 m, preferably at least 2.50 m, in particular at least 3.00 m, considerably more packing stations can be realised on the area available in a logistic center than is currently customary.

According to another preferred embodiment of the invention, which can be combined with the previous ones, the deflection device is realized as a switch with a deflection shovel. The deflection shovel may be configured to at least partially lifting feed of at least one cushion product to at least one packing station, the deflection shovel comprising a shovel surface which is angled at least in sections, in particular starting from the lower end of the shovel surface, over at least 1 cm, at least 2 cm, at least 3 cm, and/or at most completely, at most 10 cm or at most 5 cm relative to the vertical direction, in particular by 5° to 45°, preferably 8° to 16°, for example about 10°. Preferably the deflection shovel can be pivoted about a vertical pivot axis, in particular by a maximum of 90°, whereby the vertical pivot axis preferably extends crookedly beside the main conveyor line, in particular the belt conveyor.

In accordance with a further embodiment of the invention, which can be combined with the previous ones, the cushion supply system comprises at least one, preferably optical, transport good sensor which is associated with a deflection device and is configured to determine, in particular convey line upstream of the associated deflection device, whether at least one cushion product is present or arranged at a predetermined location of the cushion transport system. For example, each deflection device can each comprise an associated, preferably optical, transport good sensor, so that an electronic control and/or regulating system of the cushion supply system can selectively control a deflection device for feeding at least one cushion product from the main conveyor line to a packing station, if at least one cushion product is located in the detection region of the deflection device to be controlled.

According to a preferred embodiment of the invention, which can be combined with the previous ones, the main conveyor line comprises several individually movable transport device sections, such as conveyor belt sections with separate conveyor belts. Several transport device sections are preferably connected in series, in particular to form the main conveyor line. It is also conceivable that transport device sections form at least one secondary conveyor line starting from the main conveyor line. A cushion supply system having a main conveyor line and at least one secondary conveyor line may, for example, have a deflection device or the like for feeding the cushion products from the main conveyor line to the secondary conveyor line. By assembling a main conveyor line from several individually movable transport device sections, the cushion supply system can be scaled in a particularly simple way in order to easily expand an existing cushion supply system with additional packing stations. The use of a main conveyor line, which is comprised of individually movable transport device sections, is simplified also the control of the cushion supply system, as the transport device can be controlled section by section for the targeted transport of cushion products to individual packaging stations. This is particularly advantageous when at a cushion supply system a packing station remote to the cushion source comprises of sufficient cushion products, while a cushion source close to the packing station has a requirement for cushion products, because then only the transport device section or sections up to the packing station cushioning product requirement need to be driven to transport cushion products from the cushioning product source to the packing station cushion product requirement. The remaining transport device sections of the cushion transport system can stand still in the meantime, which allows these remaining sections of the cushion transport system to hold a buffer amount of cushion products.

According to a preferred embodiment of the cushion supply system according to the invention with deflection devices and transport device sections, a deflection device and a transport device section, such as a conveyor belt section, as well as, if necessary, a stock removal container, each form a conveyor segment with coordinated control and/or regulation.

According to a preferred embodiment of the invention, the cushion transport system comprises control and/or regulation electronic to control the cushion transport system and/or cushion source. The control and/or regulation electronic can preferably be connected to at least one filling level sensor and/or at least one filling quantity sensor in accordance with signal transmission in order to actuate the cushion source and/or the cushion transport system depending on a detected filling level or a detected filling quantity. The control and/or regulation electronic may be connected to the at least one deflection device in accordance with signal transmission and, if appropriate, to at least one transport good sensor of the at least one deflection device in order to actuate the deflection device(s). The control and/or regulation electronic is preferably connected to the several conveyor segments in accordance with signal transmission, whereby each conveyor segment may comprise its own decentralised control and/or regulation subunit for controlling local processes, which can be controlled or regulated by the higher-level control and/or regulation electronic of the cushion supply system. The control and/or regulation electronic of the cushion preparation system may have decentralised control and/or regulation electronic units as part of individual conveyor segments.

In accordance with a preferred embodiment of the invention, the control and/or regulation electronic is configured to deliver cushion products to individual packing stations according to a predetermined prioritization, whereby the packing station furthest away from the cushion source is assigned the highest priority and the packing station closest to the cushion source the lowest priority. By assigning an increasing filling prioritization to the individual packing stations, in particular stock withdrawal containers, depending on the distance to the cushion source, it is ensured that all packing stations are always supplied with cushion products. If two packing stations have a simultaneous requirement for cushion products, e.g. determined by a respective filling level sensor, the control and/or regulation electronic ensures that the packing station with the higher filling priority is filled first. This prioritisation of the conveyor segments also ensures that it is avoided that cushion pads are pushed onto a conveyor segment in the direction of conveyance in which there is no requirement for cushion pads, so that no cushion pad accumulation occurs at this point.

In case of a cushion supply system at whose packing stations stock withdrawal containers are provided which comprise two or more filling level sensors or one filling quantity sensor, the predetermined prioritisation of the respective packing station can be modified depending on the actual filling height—in the stock withdrawal container. For example, a stock withdrawal container may have two level sensors of which a lower one may detect an empty or almost empty stock withdrawal container condition, whereas the upper filling level sensor may detect a stock withdrawal container condition of at least 50% or at least 75%. A general requirement for refilling by the control and/or regulation electronic already occurs when the level falls below the level determined by the upper filling level sensor, and modification by increasing the filling prioritization then, when at the lower filling level sensor a drop below the level determined there is detected. If a filling quantity sensor is used instead of several filling level sensors, the control and/or regulation electronic can have one or more limit values with regard to the measured current filling quantity or current filling level in order to determine the refilling requirement of the packing station and, if necessary, to modify the filling prioritization of the packing station. Such embodiment improves the controllability of the cushion supply system according to the invention.

According to another preferred embodiment of an cushion supply system, which can be combined with the previous one, the control and/or regulation electronic is configured to control the cushion source according to the operation in such a way that at least one cushion product, preferably several cushion products, is always located in the cushion transport system, in particular on the belt conveyor. In this way it can be ensured that the cushion transport system always keeps a certain buffer quantity of cushion products available in addition to the cushion products at the packaging stations, in particular in the stock withdrawal containers.

In accordance with a further embodiment of the cushion supply system which can be combined with the previous ones, the control and/or regulation electronic is configured to control the cushion source and the cushion transport system in such a way that, in particular, exclusively predetermined series of cushion products are (provided and) transported, each series consisting of several cushion products, preferably two, three, five, seven, nine, ten, twenty or more cushion products, and a conveying gap, in particular consisting thereof, in particular the conveying gap having a length in the conveying direction which is at least as long as at least one cushion product of the series, wherein in particular the conveying gap being at least as long as the total length of the cushion products of the series. A series is preferably defined in such a way that it begins with the several cushioning products in conveying direction first and has the conveying gap in conveying direction last. Between the cushion products in front in conveying direction, small conveying distances may be formed, which are, however, smaller than a conveying gap according to development, preferably smaller than the length of a single cushion product. By producing the cushion products in predetermined series from a predetermined number of cushion products and a conveying gap from the cushion source and transporting them through the cushion transport system, the cushion supply system is particularly well controllable.

According to a preferred embodiment of the invention, which can be combined with the previous ones, the control and/or regulation electronic is configured to successively switch on or off the transport device sections, especially depending on the sensor, preferably depending on a transport good sensor. Such a position is particularly advantageous in connection with the use of conveyor segments. With the aid of the transport good sensor, it can be determined whether a predetermined amount of cushion products can be present on a transport device section or, in particular, whether it can be ensured by the transport good sensor that the transport device section is kept in operation for at least one cushion product until the predetermined amount of cushion products is present on the transport device section. The transport good sensor may be configured to turn on the transport device section for the transport of cushion products when no cushion product is detected at the predetermined location of the transport good sensor. Preferably the control and/or regulation electronic can be configured to switch off a transport device section for transporting cushion products if at least one cushion pad is detected at the predetermined location of at least one transport good sensor for a sufficient period of, for example, at least 0.1 second, 0.25 seconds, 0.5 seconds or 1.0 seconds, preferably 0.1 seconds to 0.2 seconds. The transport good sensor preferentially detects the first cushion pad following a conveying gap and thus in particular the beginning of a subsequent cushion product series.

According to another embodiment of the cushion system according to the invention, which can be combined with the previous ones, the control and/or regulation electronic is configured to switch the deflection device(s) active or passive, in particular depending on the sensor, preferably depending on a transport good sensor. For example, a deflection device for deflecting cushion products to a packing station can be actively switched if the control and/or regulating electronic have detected that no higher-priority, in particular downstream, packing station and/or no downstream cushion transport system section has a refilling requirement. In accordance with a particularly simple and preferred embodiment of a cushion supply system in accordance with the invention, it can be determined, depending on a sensor, in particular a transport good sensor, directly upstream and/or downstream in conveying direction of the deflection device that the deflection device is switched to active, in particular only if this sensor detects the presence of at least one cushion product. By determining by a sensor, for example a filling level sensor, a filling quantity sensor or a transport good sensor from the control and/or regulating electronic that a packing station other than that to which the deflection device is assigned has a refilling requirement of higher filling priority, the control and/or regulating electronic is designed to passively switch the deflection device in such a way that it does not discharge any cushioning products to the packing station assigned to it.

According to a preferred embodiment of the invention, which can be combined with the previous ones, the control and/or regulation electronic is configured to control the cushion source in such a way that it provides the cushion products, particularly produced, when a sensor, such as a level sensor or a quantity sensor, emits a signal indicating a cushion product demand. In this way, an automatic activation of the cushion source can be carried out easily according to a demand. Preferably the control and/or regulation electronic is configured to control the cushion source in such a way as to stop a provision, in particular a production, of new cushion products or further cushion products if no acute demand for cushion products is determined in the cushion supply system, for example if the filling quantity or filling level sensors as well as any existing transport good sensors, preferably all of them, for the control and/or regulation electronic indicates that sufficient cushion products are present in the cushion supply system.

The invention also concerns an method of operation for an cushion supply system, in particular a cushion supply system as described above, for a logistic center, for example a warehouse or a dispatch hall, for conveying cushion products from preferably exactly one cushion source to several, in particular four, six, eight, ten or more packing stations. In the method of operation according to the invention, at least one cushion product, such as at least one cushion pad, in particular made of paper, preferably recycled paper or waste paper, is provided, in particular from a starting material which may be available, for example, as a roll or leporello stack. In accordance with the method of operation according to the invention, the provided cushion product is transported, whereby the cushion product is transported in such a way that the cushion product is conveyed from the cushion source to one of the several packing stations. For this purpose, a cushion transport system of the cushion supply system, such as a belt conveyor and/or a particular switch type deflection device, may be used. In addition, the provided cushion product is delivered to one of the several packing stations in accordance with the method of operation according to the invention. After delivery to one of the several packing stations, the provided cushion product may be stored, for example, in a stock withdrawal container or the like together with other provided cushion product in accordance with the method of operation according to the invention.

The method of operation may have multiple conveying states, on which depends, to which one of the multiple packing stations the cushion product provided by the cushion source is conveyed. It is possible to switch between the different operating states using a switching logic, which can be implemented, for example, by the control and/or regulation electronic of a cushion supply system.

With the method of operation, one or more cushion products can be provided, in particular produced, by the cushion source, preferably transported by an cushion transport device, depending on the requirement for the cushion product, and finally delivered to one of the plurality of packing stations depending on the control state of the method of operation, wherein a control logic preferably depends on the cushion product requirement of the packing station and/or an particularly predetermined filling prioritization deciding which of the packing stations is supplied by the cushion source with one or more cushion product(s) via the cushion transport system.

In accordance with a preferred embodiment of the method of operation according to the invention, the provision of cushion products, in particular through the cushion source, always includes series comprising several cushion products, in particular three, five, nine, 21 or more, and preferably a subsequent conveying gap. Preferably, cushion products are always provided in a series consisting of several cushion products and a subsequent conveying gap in conveying direction, whereby no conveying distance or a small conveying distance smaller than the conveying gap, in particular smaller than half the length of a cushioning product, can exist between the cushioning products. Cushioning products, in particular cushion pads, preferably paper cushion pads, in particular recycled paper cushion pads or waste paper cushion pads, are preferably provided from an cushion source, having a width of preferably 5 cm to 50 cm, in particular 10 cm to 30 cm, preferably a width of approximately 15 cm, and/or a length of 15 cm to 300 cm, in particular 30 cm to 150 cm, preferably 35 cm to 75 cm, in particular preferably 40 cm. Preferably the cushion products can be provided, in particular produced, by a cushion source and/or according to one of the production methods of EP 2 711 167 B1, EP 2 711 168 B1 and WO 2015 039 756 A1.

According to a preferred embodiment of a method of operation according to the invention, a filling level and/or a filling quantity is detected at least at one of the packing stations, in particular at all packing stations, by a sensor, such as a filling level sensor and/or a filling quantity sensor.

An electronic control and/or regulating system can compare the detected level and/or the detected quantity of the at least one packing station with at least one threshold value in order to determine a stock withdrawal container-specific requirement which can be referred to as refill requirement or cushion product requirement. The control and/or regulation electronic can in particular cause the cushion source to provide a quantity of cushion products corresponding to the determined demand.

According to a preferred embodiment of the method of operation according to the invention, the delivery of cushion products to one of the several packing stations can take place according to a predetermined prioritization. Preferably the packing station furthest away from the cushion source has the highest priority and the packing station closest to the cushion source the lowest priority.

According to a preferred embodiment of the invention, the transport of at least one cushion product, preferably the several cushion products, in particular the cushion product series, takes place with a main conveyor line consisting of several segments. The individual segments are preferably driven individually, independently of each other, whereby each individual segment can be driven or stopped independently of each other segment.

According to a preferred embodiment of the method of operation according to the invention, an individual conveyor segment can follow depending on the status of the immediately following packing station, depending on the status of an immediately downstream conveyor segment and/or a measuring state of a material sensor related to the respective conveyor segment. Each individual conveyor segment preferably has a cushion transport system section, such as a belt conveyor section, for conveying cushion products in main conveying direction, as well as a controllable deflection device with which at least one cushion product can be delivered from the cushion transport system section to one of the plurality of packing stations, for example in that the deflection device is pivoted in a switch-like manner about a pivot axis in order to move at least one cushion product from the cushion transport system to the packing station, in particular in a shovel-like manner. For example, the conveying segment can be controlled in such a way that the cushion product transport system sections are operated for cushion product transport as long as a conveyed product sensor detects that, in particular for the duration of a predetermined measuring period of, for example, one second, two seconds, three seconds or longer, at a predetermined location the presence of cushion products or an cushion product is not permanently detected. Furthermore, the control can be done in such a way that the conveyor segment is operated to convey cushioned products as long as the conveyor segment immediately downstream does not stand still. If, for example with the aid of a filling level sensor or filling quantity sensor, the packing station immediately adjoining the conveyor segment indicates that there is a cushion product requirement, the deflection device of the conveyor segment can be controlled to deliver cushion products to the immediately adjoining packing station, wherein in particular the delivery to the immediately adjoining packing station only taking place if the conveyor segment immediately downstream of the conveyor segment is stationary or does not indicate a cushion product requirement downstream of the conveyor segment. A conveyor segment can be controlled by a conveyor segment's own control and/or electronic subunit or by central control and/or regulation electronic of the cushion supply system.

In accordance with a preferred embodiment of the method of operation according to the invention, the delivery of at least one cushion product to a packing station comprises that at least one cushion product is diverted from the cushion transport system to the respective packing station by a deflector device such as a switch, a trap door or the like.

According to a preferred embodiment of the invention, the delivery in which at least one cushioning product, preferably the cushion products of a cushion product series, is lifted from an cushion transport system, takes place in such a way that the at least one cushion product falls into a stock withdrawal container of the respective packing station. The stock withdrawal container of the cushion transport system, which can be a conveyor belt, is assigned to the immediately adjacent packing station.

In accordance with a preferred embodiment of the method of operation according to the invention, the deflection device can be actuated as a function of a sensor device, in particular can be switched actively (for delivering at least one cushion product to a packing station) or passively (for leaving at least one cushion product on the cushion transport system), which sensor device detects the presence of at least one cushion product upstream of the deflection device in the cushioning transport system.

The invention also concerns a cushion supply system as described above with at least one cushion product, preferably a variety of cushion products, in particular paper cushion pads, preferably recycled paper or waste paper cushion pads. It is clear that the cushion preparation system according to the invention may preferably be configured to carry out the method of operation according to invention and the method of operation according to the invention is preferably carried out according to the functions of the cushion supply system according to the invention.

Preferred embodiments of the invention are indicated in the dependent claims. Other features, advantages and characteristics of the invention are made clear by the present description of a preferred embodiment of the invention on the basis of the enclosed drawings in which show:

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

DETAILED DESCRIPTION

Figure 1:
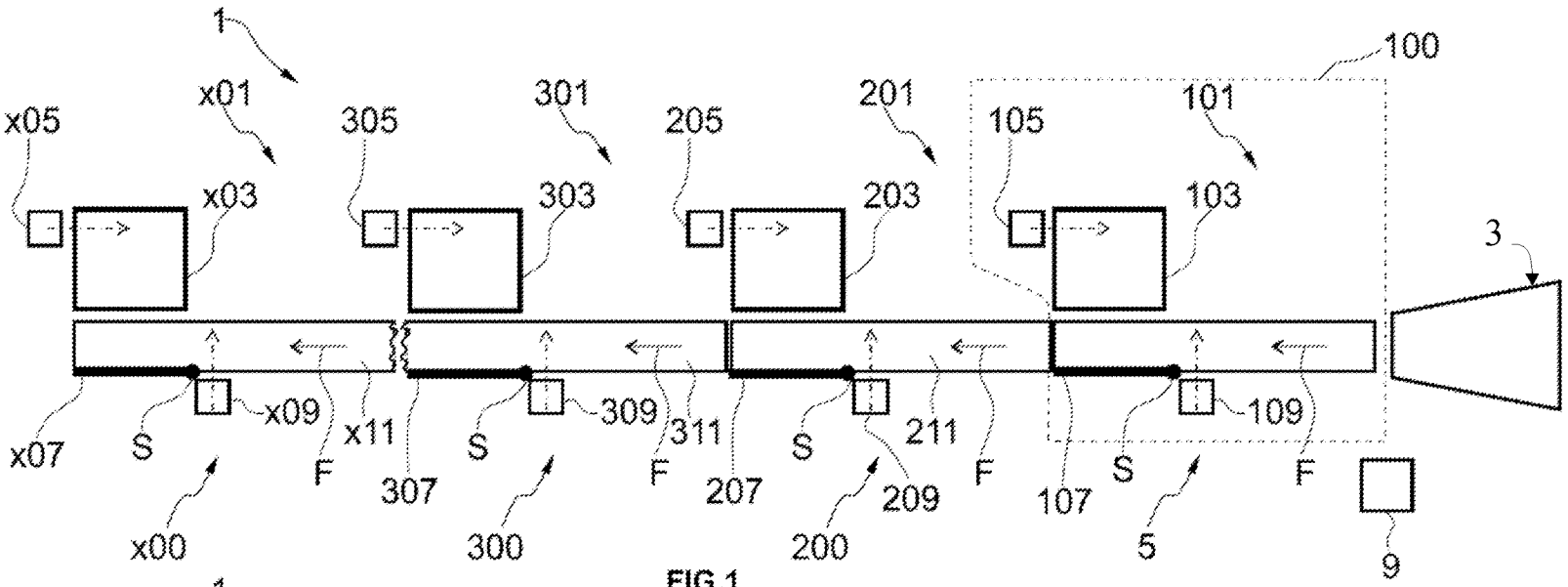
FIG. 1 a schematic top view of an cushion supply system according to the invention in an empty state in which it does not contain any cushion products.

Reference will now be made in detail to exemplary embodiments of the invention, examples of which are illustrated in the accompanying drawings. When appropriate, the same reference numbers are used throughout the drawings to refer to the same or like parts. The numerous innovative teachings of the present application will be described with particular reference to presently preferred embodiments (by way of example, and not of limitation). The present application describes several inventions, and none of the statements below should be taken as limiting the claims generally.

For simplicity and clarity of illustration, the drawing figures illustrate the general manner of construction, and description and details of well-known features and techniques may be omitted to avoid unnecessarily obscuring the invention. Additionally, elements in the drawing figures are not necessarily drawn to scale, some areas or elements may be expanded to help improve understanding of embodiments of the invention.

In the figures, a cushion supply system according to the invention is generally provided with the reference number 1. The main components of the cushion supply system are a cushion source 3, a cushion transport system 5 and several packing stations 101, 201, 301 and x01. It is clear that the number of four packing stations depicted in the figures is preferred, but that a cushion supply system 1 according to the invention can in principle also have any other number of at least two, at least six, at least ten or more packing stations. The packing stations 101, 201, 301, x01 are each part of an individual conveyor segment 100, 200, 300 or x00 according to the preferred embodiment shown. The individual conveyor segments 100, 200, 300 and x00 can essentially be designed in the same way. The components of the conveyor segments 100, 200, 300 and x00 are marked with three-digit reference numbers for simplicity's sake, wherein the first number indicating the respective conveyor segment and the two rear numbers indicating the respective conveyor segment component. For the sake of simplicity, similar reference symbols are used for the same or similar conveyor segment components.

FIG. 1 shows a schematic top view of an empty cushion supply system 1 without cushion pads or other cushion products. When using the invention-compliant cushioning supply system according to the invention-compliant method of operation described in detail below, the condition illustrated in FIG. 1 may occur, for example, if the cushioning supply system has been installed for the first time and has not yet been put into operation.

The cushion supply system 1 has a cushion source 3, which is realized as a device for the production of cushion pads 7, especially made of paper. The cushion source 3 can, for example, be fed from a paper web leporello stack or a paper web roll with a flat paper web which is transformed into individual paper cushion pads 7 by the cushion source 3. The cushion source 3 is arranged at the upstream end of a cushion transport system 5 in order to provide the cushion transport system with 5 cushion pads 7 for transport, i.e. in particular to eject them. The cushion transport system 5 consists of several (here: four) conveyor belt sections 111, 211, 311 and x11 arranged in series one behind the other, which can preferably only transport cushion products 7 unidirectionally in one direction from the cushion source 3 to the packing stations 101, 201, 301 and x01.

Each packing station 101, 201, 301 and x01 is assigned one stock withdrawal container 103, 203, 303, x03, the capacity of which can hold numerous cushion pads 7. For example, a paper cushion pad 7 can have a width of 10 cm to 30 cm, a length of 30 cm to 150 cm and a density between 3 kg/m3 or 30 kg/m3. Particularly preferably, a cushion pad 7 has a width of about 15 cm, a length of about 40 cm and a density of about 6.8 kg/m3, the density being defined with respect to a reference volume in accordance with a cuboid describing the respective cushion pad 7 in its entire circumference, at least in part, in a contact with the outer sides of the cushion. A stock withdrawal container 103, 203, 303, x03 can preferably hold 20 to 200 cushion pads 7, especially according to the preferred dimensions.

In the preferred embodiment of a cushion supply system 1, each stock withdrawal container 103, 203, 303, x03 is equipped with a filling level sensor 105, 205, 305 or x05. The filling level sensor 105 can be used to determine whether the associated stock withdrawal container 103 contains a sufficient quantity of cushion pads 7 so that the filling level of the stock withdrawal container 103 occupied by the cushion pads 7 is occupied by cushion pads 7 up to a predetermined filling level. The filling level sensor 105 preferably detects whether cushion pads 7 are arranged at a predetermined fill level in the upper half, in particular in the upper third, preferably in the upper quarter of the stock withdrawal container. If the cushion pad filling height is below the predetermined filling height detected by the filling level sensor 105, the control and/or regulating electronic 9 of the cushion supply system 1 registers that there is a cushion product requirement at the packing station 101 in the stock withdrawal container 103. For example, a horizontally aligned light barrier can be provided as filling level sensor 105. Other measurement methods are also conceivable. For example, a (non-displayed) filling level sensor can detect the weight of the cushion pads in a stock container to determine whether the total weight of cushion pads 7 in a stock withdrawal container 103 is above a fill weight threshold or not.

In the preferred embodiment shown in the figures, the cushion pads 7 are conveyed from the cushion source 3 to the stock withdrawal containers 103, 203, 303 and x03 of the packing station 101, 201, 301 or x01 by means of conveyor belt sections 111, 211, 311, x11 arranged in series. At each of the conveyor belt sections 111, 211, 311, x11 a switch 107, 207, 307 or x07 is provided for deflecting at least one cushion pad 7 from the respective conveyor belt section 111, 211, 311 or x11 in a stock withdrawal container 103, 203, 303 or x03 arranged directly adjacent thereto. In order to load the stock withdrawal container 103 with cushion pads 7, the associated switch 107 can move from its passive position shown in FIG. 1, in which the switch allows cushion pads 7 to pass unhindered on its associated conveyor belt portion 111, to an active position (not shown), in which the switch 107 deflects the cushion pads 7 moved by the conveyor belt portion 111 so as to fall laterally from the conveyor belt portion 111 down into an upper opening of the stock withdrawal container 103. Preferably, an transport good sensor 109 is arranged in upstream convey direction of the switch 107, i.e. in conveying direction F, which detects whether at least one cushion pad 7 is arranged on the conveyor belt section 111 at this point or not.

In the preferred embodiment shown in the figures of an invention-compliant cushion supply system 1, an individually controllable conveyor segment 100 (or 200, 300 or x00) is formed, which comprises a transport device section in the form of a conveyor belt section 111, a deflection device in the form of a switch 107 and a stock withdrawal container 103, and optionally a segment's own control and/or regulating electronic subunit (not shown). Together with a transport good sensor 109 and/or a filling level sensor 105 or filling quantity sensor, each conveyor segment 100 (or 200, 300, x00) can form an individually controllable and/or regulatable cushion supply system subgroup.

Figure 2A:
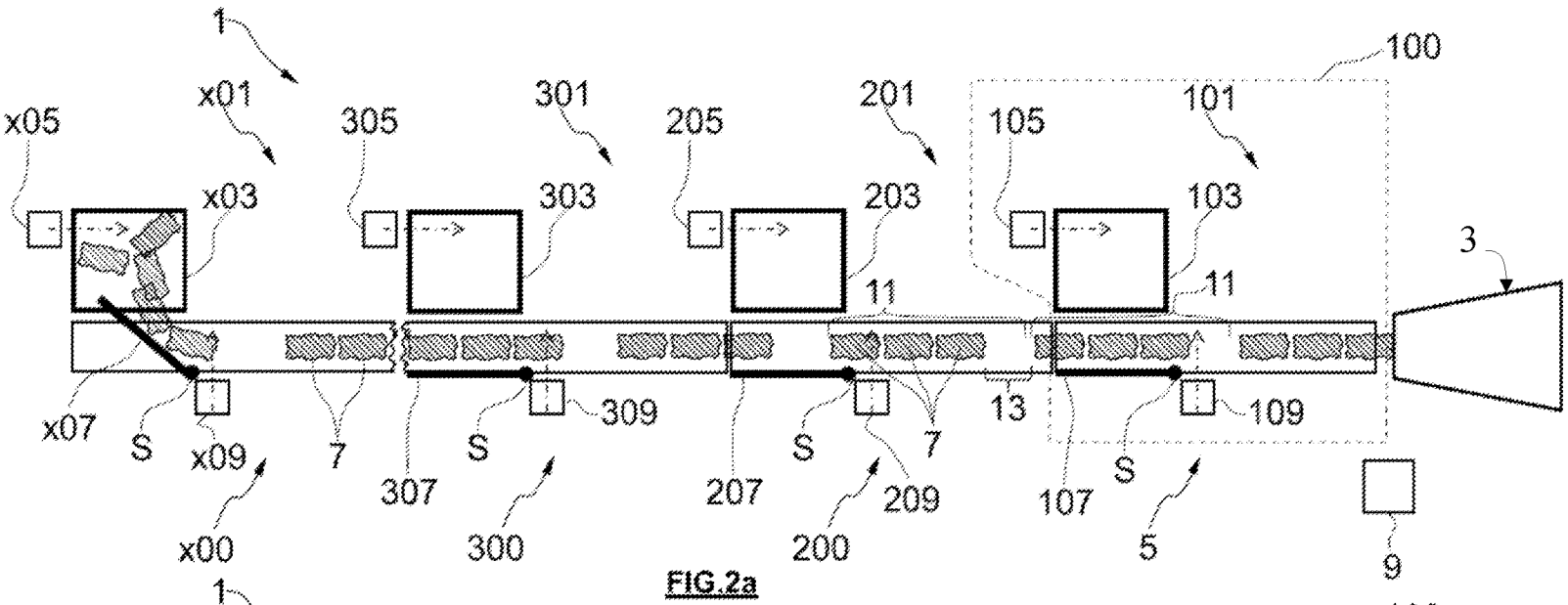
FIG. 2*a* the cushion supply system according to the invention in accordance with FIG. 1 in an operating state in which the previously empty cushion supply system is filled starting with the cushion transport system and the packing station furthest away from the cushion source.
Figure 2B:
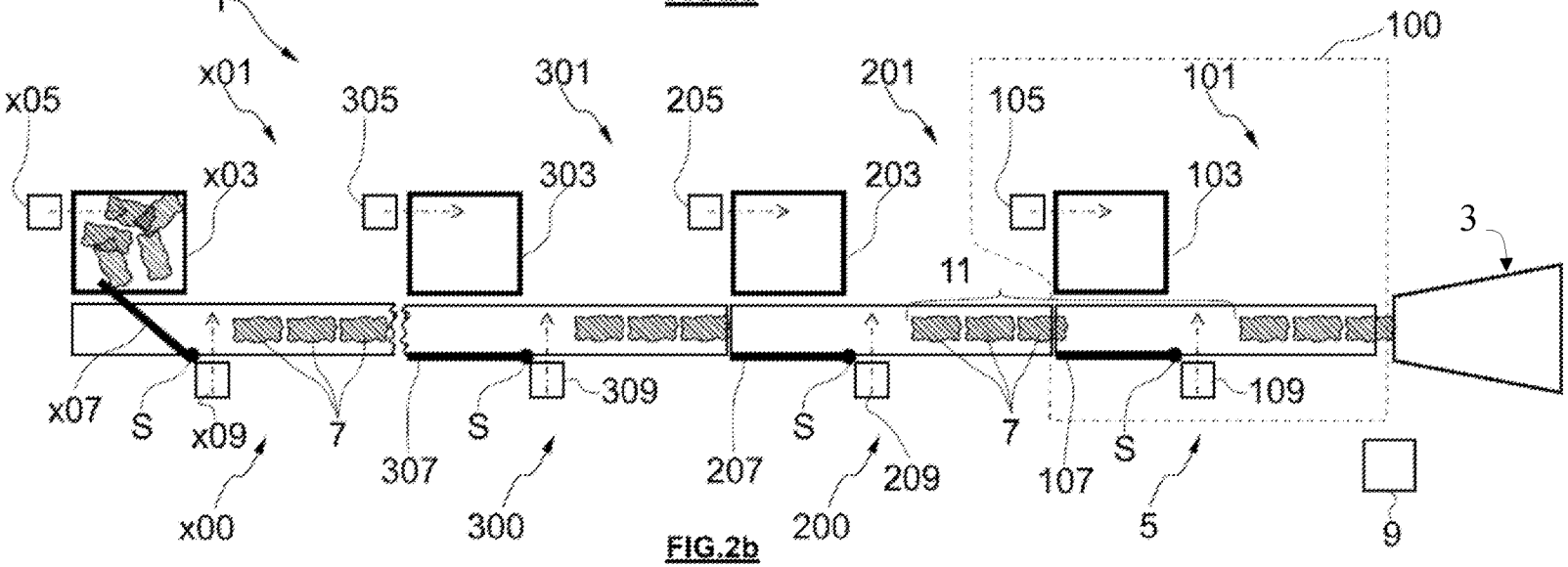
FIG. 2*b* the cushion supply system according to the invention in accordance with FIG. 1 in an operating state in which, starting from a previously completely empty cushion supply system, the packing station furthest away from the cushion source is being filled with cushion pads.
Figure 2C:
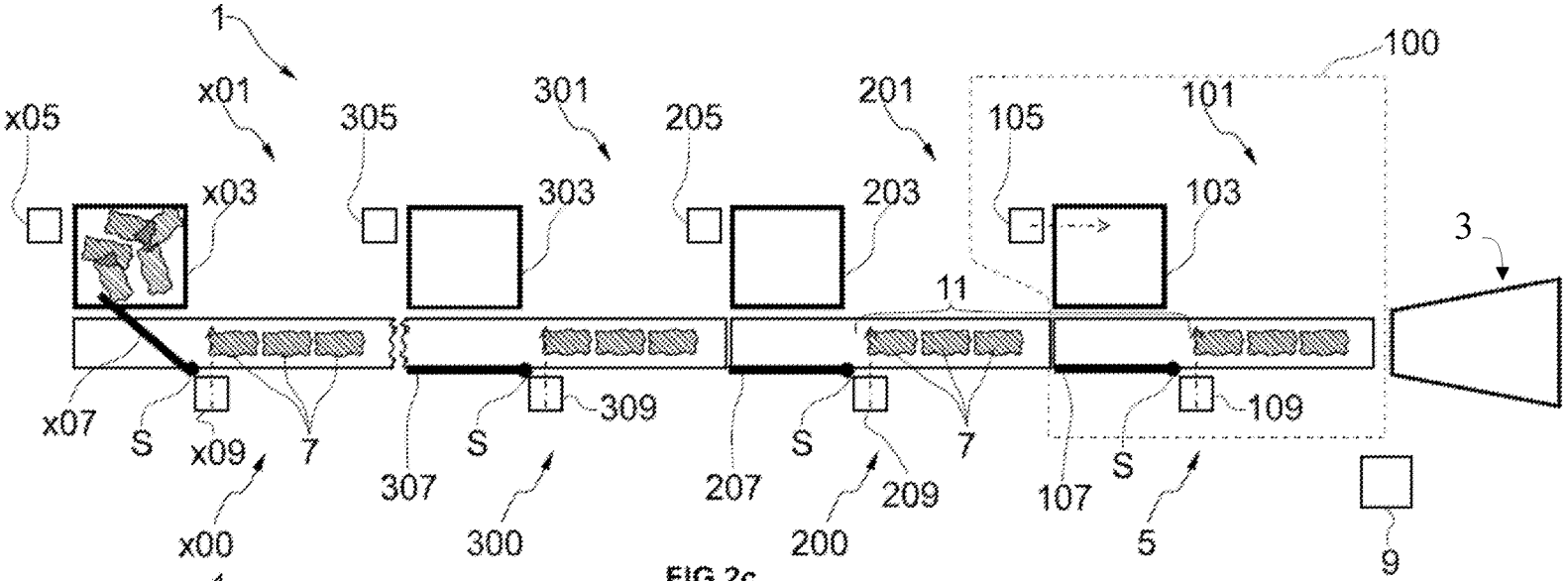
FIG. 2*c* the cushion supply system according to the invention in accordance with FIG. 1 in an operating state in which, starting from the state according to FIG. 2*b*, the packing station furthest away from the cushion source and the cushion transport system are just filled with cushion pads.

FIGS. 2*a*, 2*b* and 2*c* illustrate how, starting from the cushion supply systems 1 shown in FIG. 1 in an operating state in which it is completely empty of cushion pads 7 or other cushion products, cushion supply system is filled. The control and/or regulation electronic 9 is configured in such a way that when filling the stock withdrawal containers 103, 203, 303 and x03 of the individual packing stations 101, 201, 301 or x01, a filling prioritisation is taken into account according to which the packing station furthest away from the cushion source 3, in this case x01, enjoys the highest filling priority. The packing station 101 next to the cushion source 3 in conveying direction F is assigned the lowest filling priority accordingly. The further away a packing station 101, 201, 301 to x01 is from a cushion source 3 in conveying direction F, the higher the filling priority of the respective packing station is with this preferred configuration. In this way, it is to be ensured that during operation of the cushion supply system it is avoided that a packing station remote from the cushion source or furthest from the cushion source runs empty because packing stations arranged upstream of it also show a requirement for cushion material. In particular for an initialisation procedure for the first filling of an cushion supply system 1 it is nevertheless conceivable that another prioritisation, e.g. according to the first come, first serve principle, the packing stations 101, 201, 301 to x01 in conveying direction F are filled one after the other.

Cushion supply system 1 may be equipped with at least one emergency stop switch for disconnecting the power supply to cushion supply system 1. When an emergency condition occurs, cushion supply system 1 may re-initialise, as described in FIGS. 1, 2*a* to 2*c*, 3 and 4, as in an emergency the cushion supply system 1 is likely to be largely filtered with cushion products, so that this re-initialisation after an emergency will generally be very rapid, as a complete refill of the stock withdrawal containers 103, 203, 303 to x03 will not necessarily be necessary.

In accordance with the preferred method of operation as illustrated in FIG. 2*a*, the packing station x01 furthest away from the cushion source enjoys the highest filling priority. Cushion pads 7 are transported for the fastest possible filling of the stock withdrawal container x03 the packing station x01 with the highest filling priority. For this purpose, the control and/or regulation electronic 9 of cushion supply system 1 activates cushion source 3 to produce cushion pads 7.

It is preferred that the cushion pads 7 are transferred from the cushion source 3 to the transport system 5 in such a way that cushion pad series 11 are always conveyed along the cushion transport system 5 consisting of a predetermined number of cushion pads 7 and an adjacent conveying gap 13. For simplicity's sake, FIGS. 2*a* to 2*c* show the production series or cushion series 11 as consisting of three cushion pads 7 and an adjacent conveying gap 13, with small conveying distances between the cushion pads 7. The conveying gap 13 extends from the last cushion pad 7 of series 11 in conveying direction F to the following first cushion pad of series 11.

A production and conveying of cushion pads 7 in series 11 can, for example, be realized that the first conveyor belt section 111 immediately adjacent to the cushion source 3 in the conveying direction F moves continuously in the conveying direction F, while the cushion source 3 first provides the predetermined number of cushion pads 7 of a series 11, i.e. preferably produces and ejects them, and then pauses briefly. It is also conceivable that the paper source 3 is operated at continuous ejection speed and the conveying speed of the first conveyor belt section 111 varies such that product series 11 consisting of a predetermined amount of cushion pads 7 and a conveying gap 13 are formed. The transport of cushion pads 7 in series 11 consisting of a predetermined number of cushion pads, a conveying gap 13 and possibly small conveying distances 7 between the cushion pads ensures that no compression pressure occurs between successive cushion pads 7 in conveying direction F which could lead to a deformation of the cushion pads 7 in the sense of compression, which would result in a deteriorated cushioning effect of the cushion pads 7.

In order to fill the stock withdrawal container x03 of the packing station x01 with cushion pads 7, the deflector switch x07 of the conveyor segment x00 is brought into its active position so that it transports the cushion pads 7 from the conveyor section x11 in the stock withdrawal container x03. By conveying the cushion pads 7 in series 11, which have several cushion pads 7 and a gap 13, it can be ensured that the path of a switch is always cushion-free, so that when the switch is moved from the inactive to the active deflection position, no cushion product can be trapped between the switch and the conveyor section.

Filling of the stock withdrawal container x03 continues until the filling level sensor x05 of the stock withdrawal container x03 detects that the cushion pads 7 taken up in the stock withdrawal container x03 have reached or exceeded a predetermined number of cushion pads. In the example shown here, reaching the predetermined cushion pad amount can be detected by a filling level sensor x05 with a horizontal light barrier at a predetermined filling level.

The transport good sensor x09 of the conveyor belt section x11 is arranged directly upstream of the switch x07 in order to detect whether at least one cushion pad 7 is arranged at this point, or whether there is no cushion 7 pad, i.e. a gap 13. For filling the stock withdrawal container x03, the switch x07 is kept in the active switch position by the control and/or regulating electronic 9 of the cushion supply system or, for example, a control and/or regulating electronic subunit of the conveyor belt section x11 at least as long as the transport good sensor x09 detects the presence of a cushion pad 7. The presence of a cushion pad 7 is preferably detected with a particularly predetermined time tolerance, so that the conveying distances between the cushion pads 7 of a series 11 are ignored. If the filling level sensor x05 detects that the predetermined filling level has been reached or exceeded, and preferably a first cushion pad 7 following a gap 13 is subsequently detected with the transport good sensor x09 (FIG. 2*c*), the conveyor movement of conveyor belt section x11 can preferably be stopped.

If the sensors x05 and x09 of the conveyor segment x00 detect that there is no further cushion pad requirement in the conveyor segment x00, the packing station (here: 301) can be filled with the next highest filling priority. For the filling of the stock withdrawal container 303 of the conveyor segment 300 with the packing station 301, the conveyor components (conveyor belt section 311 and diverter 307) of the conveyor segment 300 are controlled in accordance with the control of the components of the conveyor segment x00 for the filling of its stock withdrawal container x03 described above with regard to FIGS. 2*a* to 2*c*, depending in particular on the filling level sensor 305 and/or the transport good sensor 309. In this way, the conveyor segments 100, 200, 300 and x00 can be served one after the other with cushion pads 7 according to their respective filling prioritisation.

Figure 3:
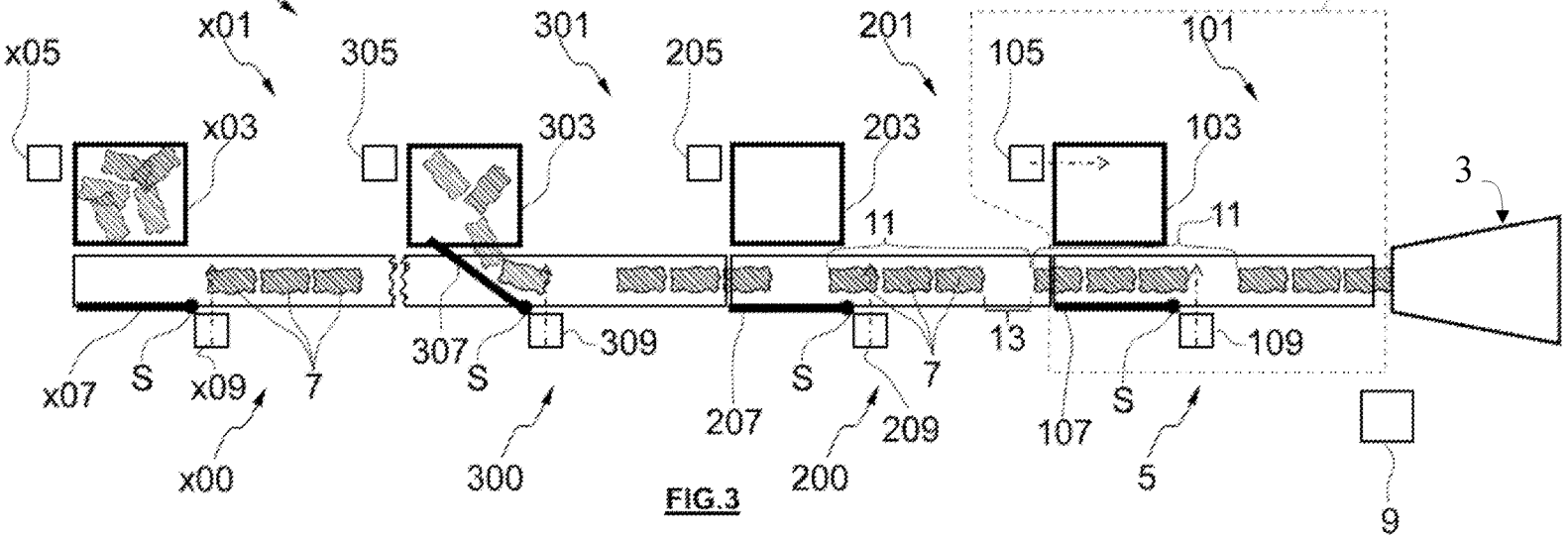
FIG. 3 the cushion supply system according to the invention in accordance with FIG. 1 in an operating state in which the two packing stations closest to the paper source require cushion pads and in which the third closest packing station to the paper source is currently filled with cushion pads.
Figure 7:
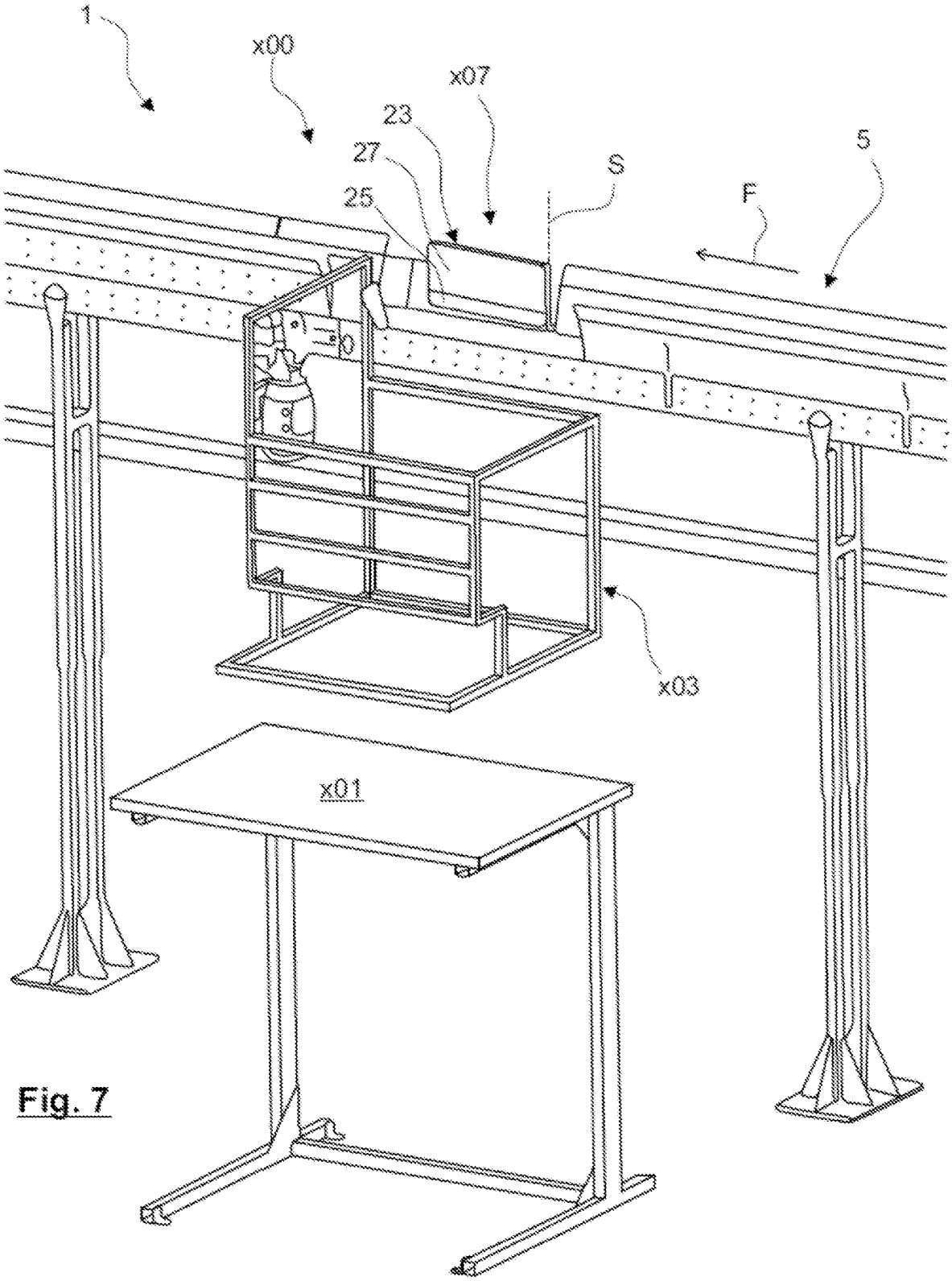
FIG. 7 perspective view of a cushion supply system according to the invention with a stock withdrawal container.

The filling of the stock withdrawal container 303 is shown in FIG. 3, whereby the filling of the stock withdrawal container 303 of packing station 301 is shown in FIG. 3 in the state which the stock withdrawal container x03 of packing station x01 has in FIG. 2*a*. A perspective view of a storage tank is shown in FIG. 7. Upstream of conveyor segment 300, the remaining conveyor section x11 is at a standstill (or the remaining conveyor sections, if more, are not shown; not shown in detail). The switch x07 or the switches of conveyor segments upstream of the conveyor segment 300 can be either in an active or passive state in the present preferred embodiment of an cushion supply system, since the deflector devices realised as switches do not act on the cushion pads as long as the respective conveyor belt section is at a standstill, if the sphere of influence of the respective deflector device or switch is limited to a conveyor gap in this state. Preferably the switches are in their passive state, so control errors can be avoided.

Preferably, the deflector device of a conveyor segment (here: x00) at the rear of the conveyor flow device can always be in the active deflection state. The switch x07 of the rear conveyor segment x00 can therefore also be implemented as positionally rigid limited to an active position. Alternatively, it is also conceivable that a further packing station (not shown) with a stock withdrawal container in conveying direction F is arranged downstream of the end of the last conveyor belt section x11. In such an arrangement, the active or passive position of the switch x07 of the last conveyor segment x00 determines whether cushion pads 7 are conveyed from the last conveyor belt section x11 with active switch x07 into the stock withdrawal container x03 of the last conveyor segment x00 shown, or, with passive position of the switch x07 into the stock withdrawal container of another packing station (not shown).

Figure 4:
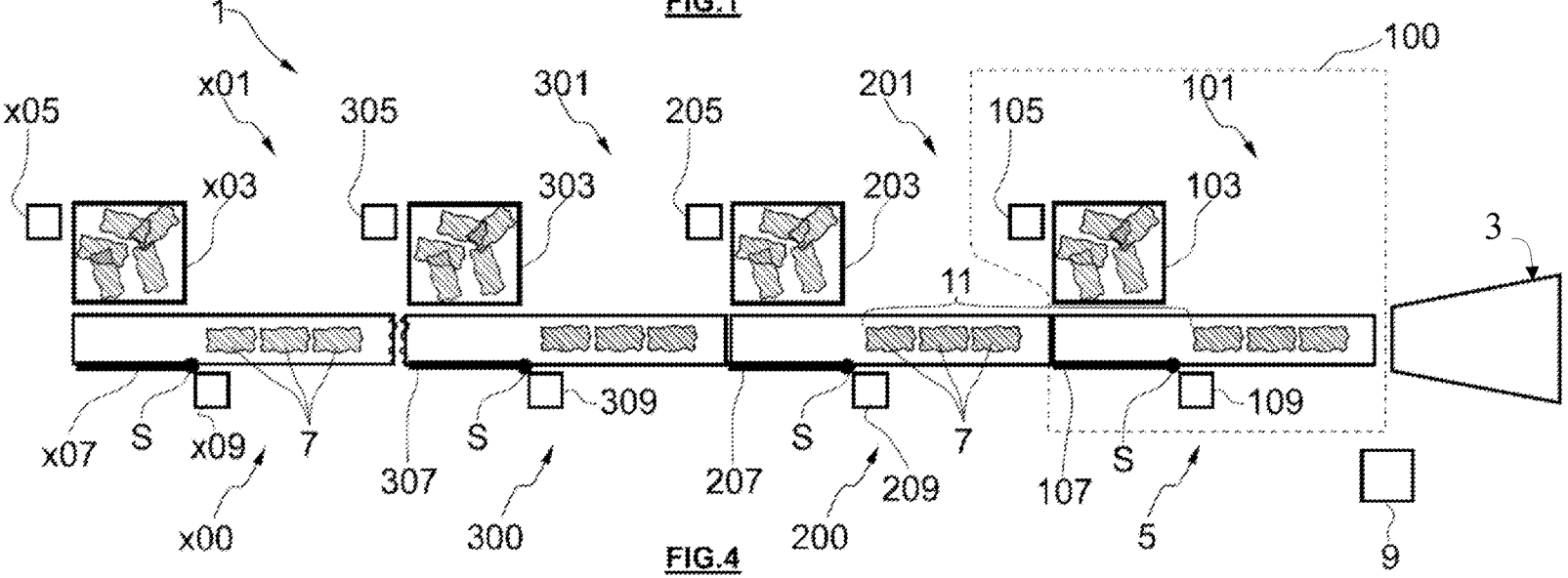
FIG. 4 the cushion supply system according to the invention in accordance with FIG. 1, in completely filled condition.

FIG. 4 shows a cushion supply system 1 completely filled with cushion pads 7, in which no cushion pad requirement is recorded in any of the stock containers 103, 203, 303, x03 and in any of the conveyor belt sections 111, 211, 311 or x11. The conveyor belt sections 111, 211, 311 and x11 of the cushion transport system 5 are at a standstill. The switches 107, 207, 307 and x07 can be in their passive position. The filling level sensors 105, 205, 305 and x05 of the stock withdrawal containers all detect a maximum fill level of cushion pads 7 in the stock withdrawal containers above the nominal fill level. Each of the transport good sensors 109, 209, 309 and x09 detect one cushion pad 7 each.

Figure 5A:
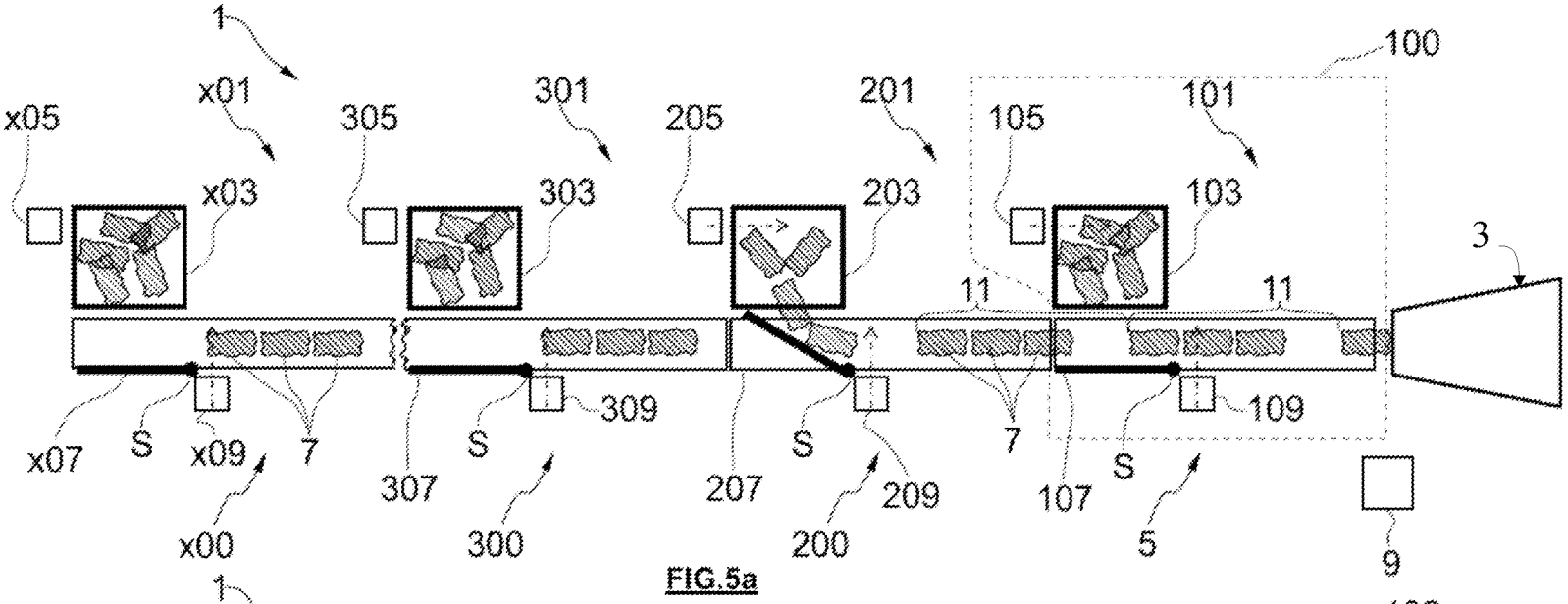
FIG. 5*a* cushion supply system according to the invention in accordance with FIG. 1 in an operating state in which a packing station requiring cushion pads is currently being filled.

FIG. 5*a* shows the cushion supply system 1 according to the invention in an operating state at packing station 201 of the second conveyor segment 200, in which a cushion pad requirement is recorded. In the stock withdrawal container 203 of packing station 201, the filling level sensor 205 detects that the current filling level on cushion pads 7 has fallen below the predetermined target fill level.

In order to fill the stock withdrawal container 203 according to FIG. 5*a* in conveying direction 2 of the packing station 201 in accordance with the detected requirement for cushion pads 7, the control and/or regulating electronic 9 of the cushion supply system 1 causes the deflection device of the second conveying segment 200, realised as a switch 207, to take its active position and cause the cushion transport system 5 to convey cushion pads 7 preferably in series 11 from the cushion source 3 to the packing station 201. To supply the second packing station 201 with cushion pads 7, all conveyor belt sections up to packing station 201, i.e. here the first conveyor belt section 111 and the second conveyor belt section 211 of the first and second conveyor segment 100, 200, are controlled to carry out a conveyor movement.

The filling of the stock withdrawal container 203 of the second packing station 201 by activating the switch 207 and the first two conveyor belt sections 111, 211 is shown in FIG. 5*a*. In the operating state of the cushion supply system 1 according to the invention shown in FIG. 5*b*, the filling level sensor 205 of the stock withdrawal container 203 detects that the cushion pads 7 in the stock withdrawal container 203 have reached or exceeded the predetermined nominal filling level. Conveyor belt sections 111 and 211 continue to move to convey series 11 of cushion pads 7. The transport good sensor 209 of the second conveyor segment 201 detects a conveying gap 13 in the condition shown in FIG. 5*b*.

Figure 5B:
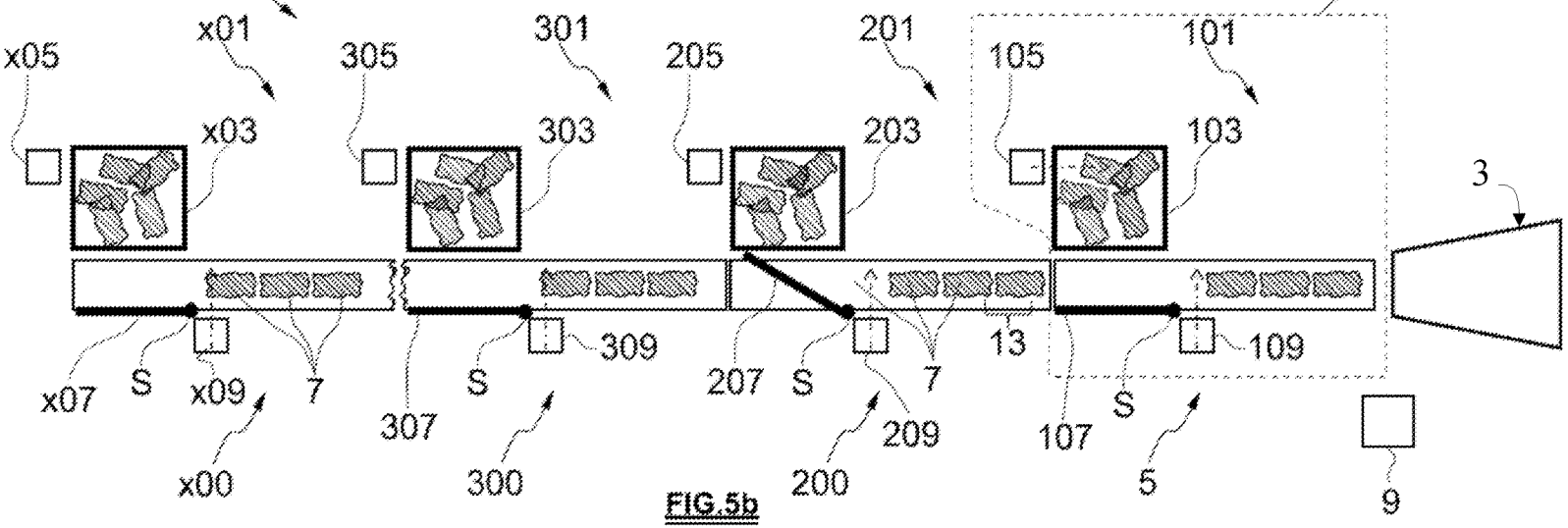
FIG. 5*b* cushion supply system according to the invention in accordance with FIG. 1 in an operating state in which starting from the operation state shown in FIG. 5*a* the requirement for cushion pads at the second packing station has just been covered.

Starting from the operating state shown in FIG. 5*b*, the first and second conveyor belt sections 111, 211 of series 11 of cushion cushions 7 move in the conveying direction F, in that first the transport good sensor 209 of the second conveyor segment 200, as shown in FIG. 4, detects a cushion pad 7 following the conveying gap 13, causes the control and/or regulating electronic 9 and/or the control and/or regulating electronic subunit of the second conveyor segment 200 the conveyor belt section 211 to stop. At the same time, the switch 207 of the second conveyor segment 200 can also be caused to return to the passive position. At this moment there is no further requirement for cushion pads 7 in the second conveyor segment 200.

If there is no further cushion pad requirement in the second conveyor segment 200 and at full stock withdrawal container 103 of the first conveyor segment 100 a cushion pad 7 within the detection region of the transport good sensor 109 is present at its transport good sensor 109, this is detected by the control and/or regulation electronic 9 and/or the control and/or regulation electronic subunit of the first conveyor segment 100, so that the first conveyor belt section, 111, and the switch 107, associated therewith can also be made inactive. As soon as this condition is reached, cushion supply system 1 returns to the fully filled condition shown in FIG. 4.

For the expert, it is readily clear that starting from the full condition as shown in FIG. 4, when identifying a requirement at any of the conveyor segments 100, 200, 300 or x00, filling can be carried out as described above, regardless of how many conveyor segments the cushion supply system 1 comprises.

Figure 6B:
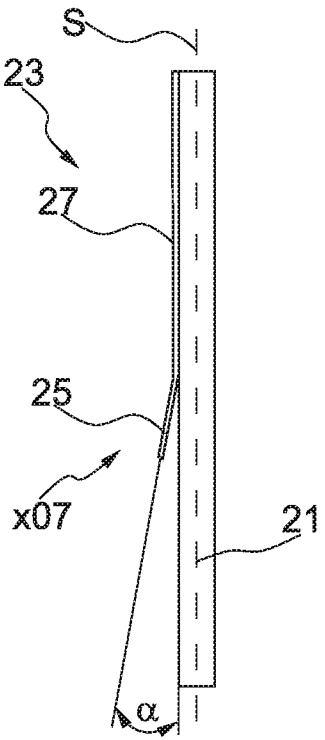
FIG. 6*b* a detailed side view of the switch according to FIG. 6*a*.
Figure 6A:
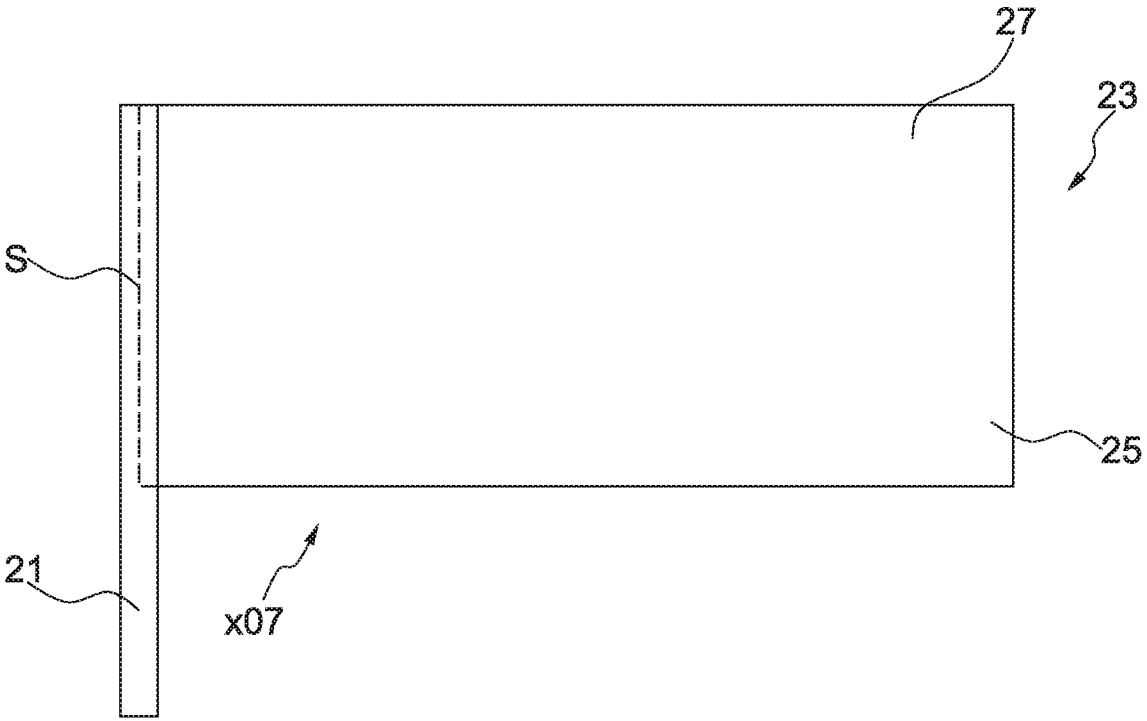
FIG. 6*a* a detailed front view of a switch.

FIGS. 6*a* and 6*b* show in detail a switch x07 for the cushion supply system 1 according to the invention. The switch x07 has a pivot shaft 21 to rotate the switch around its pivot axis S, especially between the inactive and active position. A flag 23, which has an angled lower section 25 and a flat upper section 27, is non-rotatably arranged on the pivot shaft 21. The lower flag section is angled relative to the swivel axis S extending in the vertical direction for lifting the cushion pads 7, in particular by about 10°. The upper flag section 27 extends without inclination to the vertical direction. The height of the flag 23 attached to the pivot shaft 21 can be between 10 cm and 30 cm and is preferably around 20 cm. The lower angled flag section 25 extends in vertical direction over one to 10 cm, preferably less than 5 cm, in particular about 4 cm. The length of the flag 23 of a switch x07 in conveying direction F is preferably between 20 cm and 60 cm, especially about 40 cm. The flag length is preferably at least 1.5×, in particular at least 2× as large as the width of the conveyor belt x11, from which switch x07 is to deflect cushion pads 7. The lower angled flag section 25 may alternatively be curved and/or at least half the height of a cushion pad 7.

The features revealed in the above description, figures and claims may be relevant, either individually or in any combination, to the realisation of the invention in its various forms.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents.

LIST OF REFERENCE SIGNS

1 cushion supply system
3 cushion source
5 cushion transport system
7 cushion pad
9 control- and/or regulate electronic
11 cushion pad series
13 conveying gap
21 pivot shaft
23 flag
25, 27 flag section
100, 200, 300, x00 conveyor segment
101, 201, 301, x01 packing station
101, 201, 301, x01 stock withdrawal container
105, 205, 305, x05 filling level sensor
107, 207, 307, x07 switch
109, 209, 309, x09 transport good sensor
111, 211, 311, x11 conveyor belt section
F conveying direction
S pivot axis

We claim:

1. A cushion supply system for a logistic center comprising:

a cushion source for providing cushion products having a width of 5 cm to 15 cm, a length of 15 cm to 300 cm, and a density of 1 kg/m$^3$ to 100 kg/m$^3$;

several packing stations at which containers can be loaded with goods and filled with cushion products;

a cushion transport system for transporting the cushion products from the cushion source to the packing stations, wherein the cushion source is configured to supply the plurality of packing stations;

a deflection device that includes a switch and a deflection shovel, the deflection shovel being configured to at least partially lift and feed at least one of the cushion products to at least one packing station of the plurality of packing stations;

at least one optical transport good sensor assigned to the deflection device and configured to determine, in a conveying direction upstream of the assigned deflection device, whether a cushion product is arranged at a predetermined location of the cushion transport system; and regulating electronics configured to:

control the cushion transport system to deliver the cushion products to individual packing stations of the plurality of packing stations according to a predetermined prioritization, wherein a highest priority is assigned to a packing station, of the plurality of packing stations, furthest away from the cushion source and a lowest priority is assigned to a packing station, plurality of packing stations, closest to the cushion source; and switch the deflection device actively or passively as a function of a sensor.

2. The cushion supply system according to claim 1, wherein at least one of the packing stations comprises at least 10 stock withdrawal containers.

3. The cushion supply system according to claim 1, wherein at least one stock withdrawal container has at least one filling quantity sensor for determining the filling level of the stock withdrawal container occupied by cushion products and/or in that at least one stock withdrawal container has at least one filling level sensor for detecting whether the filling level of the stock withdrawal container occupied by cushion products exceeds a predetermined filling level limit.

4. The cushion supply system according to claim 3, wherein at least one stock withdrawal container has a loading opening on an upper side for feeding cushion products from the transport system into the stock withdrawal container and/or in that at least one stock withdrawal container has an unloading opening in a horizontal direction for unloading of a cushion product by packing personnel, wherein the unloading opening being arranged between 0.8 m and 2.2 m in height.

5. The cushion supply system according to claim 4, wherein the cushion transport system comprises:

a unidirectional main conveyor line comprising a belt conveyor; and a trap door for feeding at least one cushion product from the main conveyor line to at least one packing station.

6. The cushion supply system according to claim 5, wherein the main conveyor line transports the cushion products at a height of at least 2 m and/or above the at least one stock withdrawal container in the horizontal direction.

7. The cushion supply system according to claim 5, wherein the main conveyor line comprises a plurality of individually movable transport device sections, further comprising conveyor belt sections with separate conveyor belts, wherein a plurality of transport device sections are connected in series one behind the other.

8. The cushion supply system according to claim 7, wherein the regulating electronics are configured to successively switch the transport device sections on or off based on a sensor.

9. The cushion supply system according to claim 5, wherein one of the at least one deflection device and a transport device section, comprising a conveyor belt section, and the stock withdrawal container each form a conveyor segment with control and/or regulation are coordinated with one another.

10. The cushion supply system according to claim 1, wherein the deflection device is rotatable about a vertical pivot axis.

11. The cushion supply system according to claim 1, wherein the regulating electronics are configured to control the cushion source so that at least one cushion product is always present in the belt conveyor and in the stock withdrawal container.

12. The cushion supply system according to claim 1, wherein the regulating electronics are configured to control the cushion source and the cushion transport system so that exclusively predetermined series are transported, wherein each series comprises a plurality of cushion products and a conveying gap, wherein in particular the conveying gap having a length in the conveying direction which is at least as long as a cushion product.

13. The cushion supply system according to claim 1, wherein the regulating electronics are configured to control the cushion source that it provides cushion products based on a signal, from a filling level sensor or a filling quantity sensor, that indicates a cushion product requirement.

14. A system comprising:

the cushion supply system according to claim 1; and cushion products having a width of 5 cm to 15 cm, a length of 15 cm to 300 cm and a density of 1 kg/m$^3$ to 100 kg/m$^3$.

15. A cushion supply system for a logistic center comprising:

a cushion source for providing cushion products having a width of 5 cm to 50 cm, a length of 15 cm to 300 cm and a density of 1 kg/m$^3$ to 100 kg/m$^3$, wherein the cushion source transforms a flat paper web into individual cushion products;

several packing stations at which containers can be loaded with goods and filled with cushion products; and a cushion transport system for transporting the cushion products from the cushion source to the packing stations, wherein the cushion source is configured to supply the plurality of packing stations, wherein the cushion source is arranged next to the cushion transport system at its upstream end.

16. A cushion supply system for a logistic center comprising: a cushion source for providing cushion products having a width of 5 cm to 50 cm, a length of 15 cm to 300 cm and a density of 1 kg/m3 to 100 kg/n3; several packing stations at which containers can be loaded with goods and filled with cushion products; and a cushion transport system for transporting the cushion products from the cushion source to the packing stations, wherein the cushion source is configured to supply the plurality of packing stations, wherein exclusively predetermined series of individual and separate cushion products are transported.

17. The cushion supply system according to claim 15, wherein the individual cushion products are separate.

* * * * *